United States Patent [19]

Adachi et al.

[11] Patent Number: 4,977,994

[45] Date of Patent: Dec. 18, 1990

[54] FARE ADJUSTMENT MACHINE FOR PREPAID CARD TYPE TICKETS

[75] Inventors: Masaharu Adachi, Gifu; Yoshiaki Uematsu, Numazu; Haruo Nagano, Ohgaki; Koji Yamada, Gifu, all of Japan

[73] Assignee: Kabushiki Kaisha Sanyo Danki Seisakusho, Gifu, Japan

[21] Appl. No.: 327,871

[22] Filed: Mar. 23, 1989

[30] Foreign Application Priority Data

Mar. 30, 1988 [JP] Japan ..... 63-42199
Jun. 27, 1988 [JP] Japan ..... 63-85615
Jun. 27, 1988 [JP] Japan ..... 63-85616

[51] Int. Cl.[5] ..... G07F 7/00

[52] U.S. Cl. ..... 194/210; 194/212; 194/344

[58] Field of Search ..... 194/205, 210, 344, 212; 235/379, 380, 384, 31 R, 31

[56] References Cited

U.S. PATENT DOCUMENTS 3,491,869 1/1970 Utz ..... 194/212
3,602,695 8/1971 Boss ..... 194/212 X
3,934,693 1/1976 Ooyama et al. ..... 194/205
3,935,933 2/1976 Tanaka et al. ..... 194/210

FOREIGN PATENT DOCUMENTS 52-11994 1/1977 Japan ..... 194/210
2137792 10/1984 United Kingdom ..... 194/210

*Primary Examiner*—H. Grant Skaggs
*Assistant Examiner*—Boris Milef
*Attorney, Agent, or Firm*—Pollock, Vande Sande and Priddy

[57] ABSTRACT

A fare adjustment machine, wherein a card conveyor for carrying a fare-adjusted card and a receipt conveyor for carrying a printed receipt are disposed with their passages intersecting each other so that the surfaces of the card and the receipt cross each other perpendicularly. The receipt is held at one-side at the intersection by a clamp mechanism and released from the receipt conveyor by a release mechanism. The receipt thus held is pushed at its lower side by the card carried by the card conveyor so that it falls down flat on top of the card, and the card and receipt are then then simultaneously discharged from the machine.

4 Claims, 11 Drawing Sheets

FARE ADJUSTMENT MACHINE FOR PREPAID CARD TYPE TICKETS

BACKGROUND OF THE INVENTION

The present invention relates to a fare adjustment machine for use with prepaid card type tickets on buses and similar means of transportation and, more particularly, to a fare adjustment machine with a receipt dispensing function which, when such a ticket is inserted thereinto, automatically makes a fare adjustment and offers a receipt showing particulars about the fare adjustment.

In a means of transportation such a bus on a regular route there has been introduced a prepaid card type ticket system with a view to simplifying fare adjustments when passengers get on or off. With this system a prepaid card type ticket of a fixed price can be used any number of times within the final limit of the ticket or within the limit of its purchase price. The ticket has, for example, a magnetic stripe for fare adjustment and the fare is subtracted from the amount of money prepaid which is magnetically recorded in the magnetic stripe.

The contents of the fare adjustment are displayed on a display of a card processor, but the display is erased at the time of processing the next ticket or will disappear after a certain elapsed time.

Conventionally there are cases where a receipt dispenser is provided for offering a receipt, in place of a ticket, to a passenger who pays the fare in cash. In the case where there are passengers who use the prepaid card type tickets and passengers who pay the fares in cash, both the card processor and the receipt dispenser must be installed, but much difficulty is experienced in finding their location owing to a limited space in a bus or similar vehicle.

It is therefore an object of the present invention to provide a fare adjustment machine with a receipt dispensing function which prints particulars about the fare adjustment on a receipt blank and ejects and offers it as a receipt to the passenger, together with his prepaid card type ticket.

Another object of the present invention is to provide a fare adjustment machine with a receipt dispensing function which is capable of offering a receipt also to a passenger who pays the fare in cash.

Yet another object of the present invention is to provide a fare adjustment machine with a receipt dispensing function which permits simultaneous ejection of a prepaid card type ticket and a receipt.

SUMMARY OF THE INVENTION

In the fare adjustment machine of the present invention, a prepaid card type ticket inserted thereinto is detected by a card detector and is fed by a card carrier to read/rewrite circuits, wherein recorded information of the ticket is read out an rewritten. A fare adjustment is made by a fare adjuster of a controller on the basis of the read-out recorded information and fare information separately input thereinto.

The contents of the fare adjustment and the input fare information are printed on rolled paper, which is then cut into a predetermined length. The receipt thus prepared is ejected, together with the fare-adjusted ticket. Alternatively, the particulars on the fare adjustment and the input fare information are printed on a receipt blank of a fixed length and the thus printed receipt is ejected, together with the fare-adjusted ticket.

To a passenger who pays the fare in cash, only such a receipt as mentioned above is offered.

As described above, the fare-adjusted ticket and the printed receipt are ejected simultaneously. To perform this, a card conveyor for carrying the fare-adjusted ticket and a receipt conveyor for carrying the printed receipt are disposed with their passages intersecting each other so that the ticket and receipt surfaces cross each other perpendicularly. At the intersection of the conveyors the receipt is held at one side by a clamp mechanism and released from the receipt conveyor by a release mechanism. The receipt thus held at one side is pushed at its lower side by the ticket carried by the card conveyor so that the receipt falls down flat on top of the ticket. Thus the ticket and the receipt are simultaneously delivered while being pinched by the discharge mechanism.

Alternatively, the receipt transferred to the intersection of the conveyors is pushed at its intermediate portion by the ticket and is folded into two to hold therebetween the ticket, and the ticket and the receipt is discharged en block by the discharge mechanism.

DESCRIPTION OF THE PREFERRED EMBODIMENTS

A detailed description will hereinafter be given, with reference to the drawings, of the fare adjustment machine for prepaid card type tickets according to the present invention.

Figure 1:
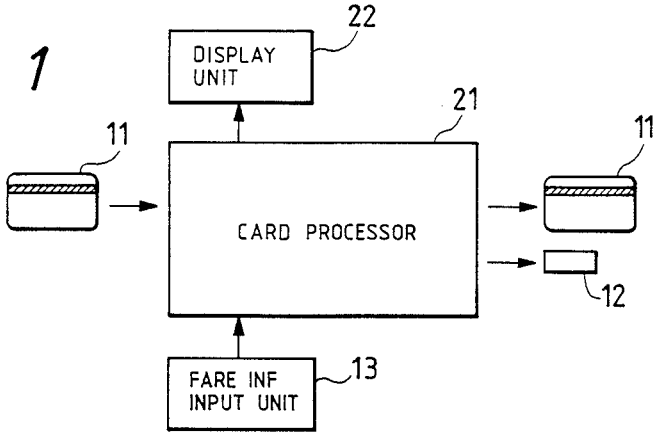
FIG. 1 is a block diagram illustrating the fare adjustment machine of the present invention.

The fare adjustment machine of the present invention, which includes a card processor 21 as shown in FIG. 1, is installed on a bus or the like beside its driver's seat, for instance. When a passenger inserts his prepaid card type ticket 11 into the card processor 21, the fare input thereinto from a fare information input unit 13 is subtracted from the amount of money recorded in the ticket 11. After the fare adjustment the remainder is displayed on a display unit 22. At this time the contents of the fare adjustment, such as the date, the remainder and the route number, and the fare are printed on a receipt 12 in the card processor 21. Then the ticket 11 and the receipt 12 are discharged to the same outlet.

Figure 2:
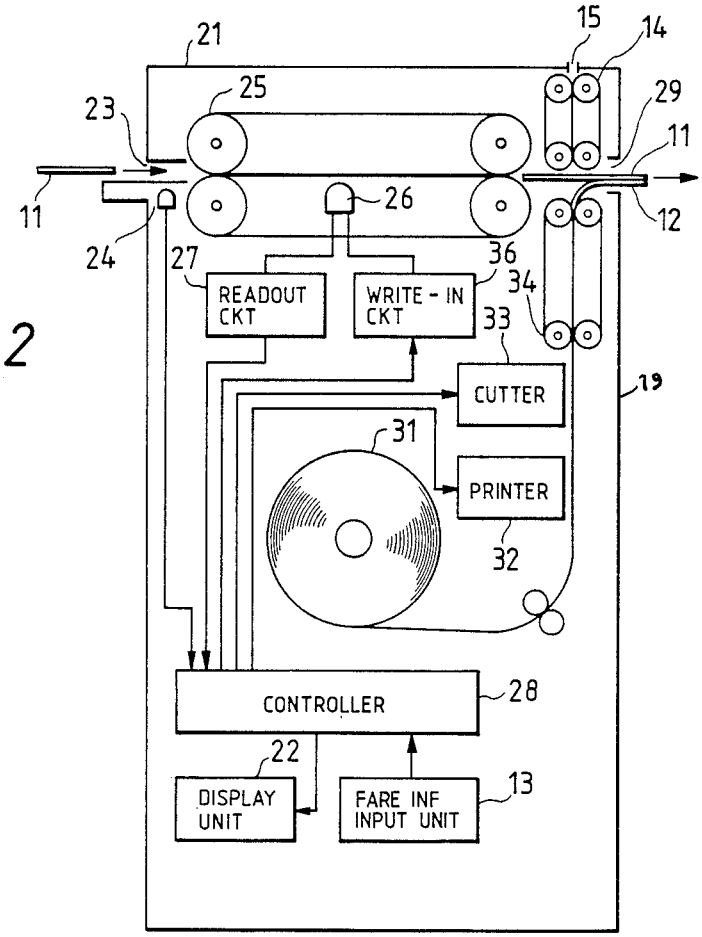
FIG. 2 is a diagram showing a specific operative example of the fare adjustment machine.

Referring next to FIG. 2, the card processor 21 will be described in detail. In a housing 19 of the card processor 21 the ticket 11 inserted thereinto from a card insertion slot 23 is detected by a card detector 24. Upon detection of the ticket, a ticket conveyor 25 is driven, by which the ticket 11 is fed to a magnetic head 26. Recorded information of the ticket 11 read out by the magnetic head 26 is reproduced by a readout circuit 27.

A controller 28 is formed by a microcomputer, which temporarily stores the read-out information in a memory, compares it with fare information (the fare) input from the fare information input unit 13, performs fare adjustment processing, and rewrites the recorded information of the ticket 11 through a write-in circuit 36 and the magnetic head 26. The ticket 11 with the thus rewritten information is temporarily held in the vicinity of the outgoing end of the card conveyor 25. The fare information input unit 13 is, for example, a keyboard, which is provided on or apart from the card processor 21 and is manipulated by the bus driver or the passenger to input the information.

The contents of fare adjustment (including the input fare information) are printed by a printer 32 on print paper which is drawn out of a supply reel 31. The printing is performed under control of the controller 28. The printed paper is cut by a cutter 33 into a predetermined length, providing a receipt 12. The receipt 12 is brought by a receipt conveyor 34 to a position where its transfer path intersects the ticket transfer path provided by the ticket conveyor 25 at an intersection inside housing 19 near a card outlet slot 29 in the housing wall. At this intersection the receipt 12 is not accessible from the outside.

Upon completion of rewriting of the recorded information of the ticket 11 and the transfer of the receipt 12 to the above-noted intersection, the ticket 11 held on the card conveyor 25 is transferred toward the card outlet slot 29. Then the ticket 11 is ejected into the slot 29 while pushing the receipt 12 held in the wait state at the above-mentioned intersection. Thus the ticket 11 and the receipt 12 can be pulled out through the slot 29 at the same time.

Figure 3A:
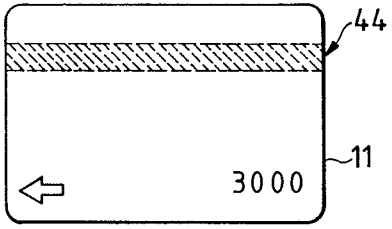
FIG. 3A illustrates an example of a prepaid card type ticket.
Figure 3B:
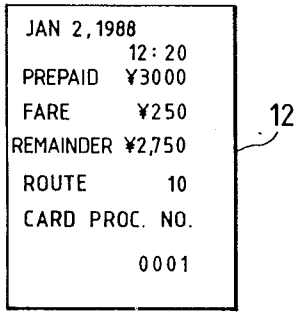
FIG. 3B is a diagram showing a receipt.

FIGS. 3A and 3B illustrate the prepaid card type ticket 11 and the receipt 12. As shown in FIG. 3A, there are printed on the front of the ticket 11 the amount of money prepaid, the kind of ticket, etc., and on the back of the ticket 11 there are magnetically recorded in a magnetic stripe 44 information such as the remainder. On the receipt 12 there are printed money information such as the amount of money prepaid, the fare paid and the remainder, and temporal information such as the date of fare adjustment, as shown in FIG. 3B.

Figure 4:
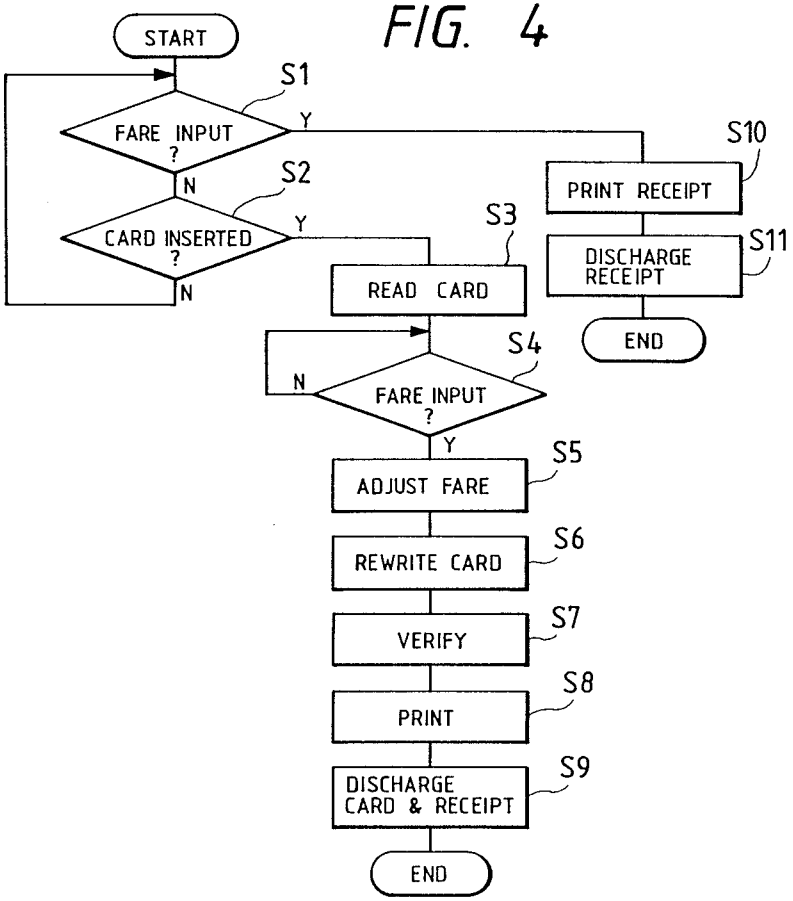
FIG. 4 is a flowchart showing an example of the operation of the fare adjustment machine of the present invention.

Next, a description will be given, with reference to the flowchart of FIG. 4, of the operation of the card processor 21 under control of the controller 28 for processing the ticket 11 and the receipt 12.

It is determined whether or not the fare information has been input (S1), and if not, then it is determined whether or not the ticket 11 has been inserted into the card processor 21 (S2). If the ticket 11 is inserted, it is detected by the card detector 24, and at the same time, the card conveyor 25 is actuated to feed it to the magnetic head 26, by which the magnetic information of the ticket 11 is read out (S3). Then the card processor 21 awaits the input of the fare information (S4) and, upon input of the information, conducts the fare adjustment (S5), rewrites the magnetic information of the ticket 11 (S6), and verifies the rewritten information (S7). Where it is determined that the rewritten information is correct, the reminder is displayed, followed by printing the contents of the fare adjustment on the print paper (S8). The printed paper is cut into a predetermined length and brought by the receipt conveyor 34 to the card outlet slot 29, thereafter being discharged therefrom along with the ticket 11 (S9).

When the fare is paid in cash, the fare information is input in step S1 and the ticket 11 is not inserted into the card processor 21. Upon input of the fare information, the controller 28 immediately controls the printer 32 to print the fare information and other information on the print paper (S10) and discharge the receipt 12 (S11). In this instance, since no ticket lies in the transfer path of the receipt 12, it is conveyed by the receipt conveyor 34 across the ticket transfer path and is then taken over to a second receipt conveyor 14 (FIG. 2), thereafter being delivered into a receipt outlet slot 15 in the wall of housing 19.

Figure 5:
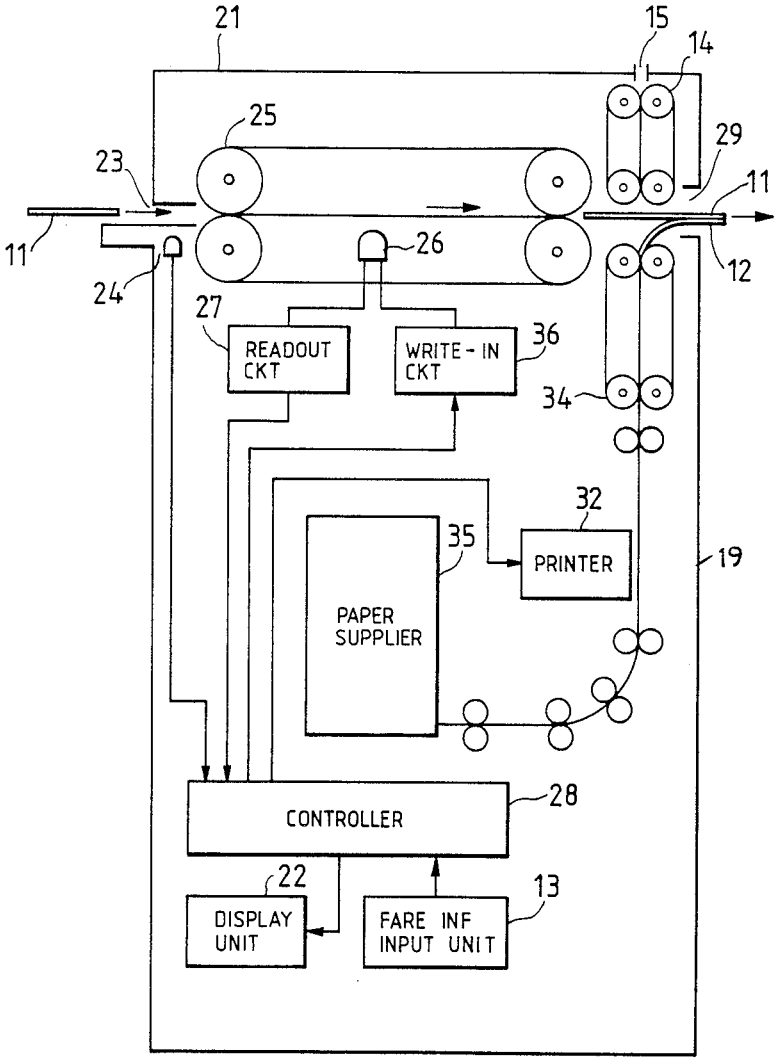
FIG. 5 is a diagram illustrating another example of the present invention.

Although in FIG. 2 the print paper is supplied from the supply reel 31 to the printer 32 and is cut into a predetermined length after printing, it is also possible to employ an arrangement in which blank receipt sheets of a fixed length, neatly piled up, are fed one by one to the printer 32 from a paper supplier 35, as depicted in FIG. 5.

Figure 6:
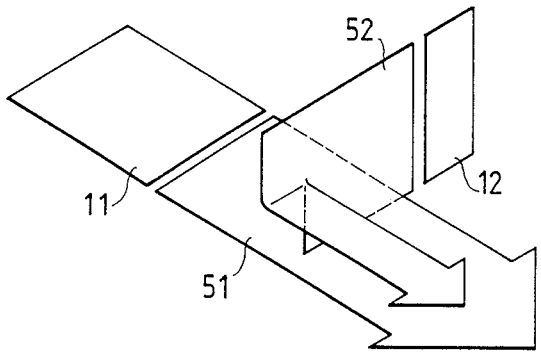
FIG. 6 is a perspective view showing the relationships of the ticket and the receipt to their passages in a batch discharging mechanism.
Figure 7A:
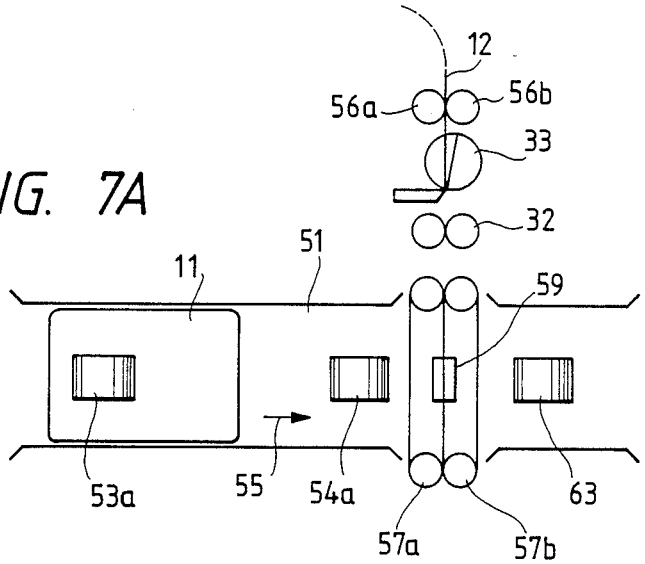
FIGS. 7A through 11B schematically illustrate an operation of the batch discharging mechanism, FIGS. 7A, 8A, 9A, 10A and 11A being its plan views and FIGS. 7B, 8B, 9B, 10B and 11B its front views.
Figure 7B:
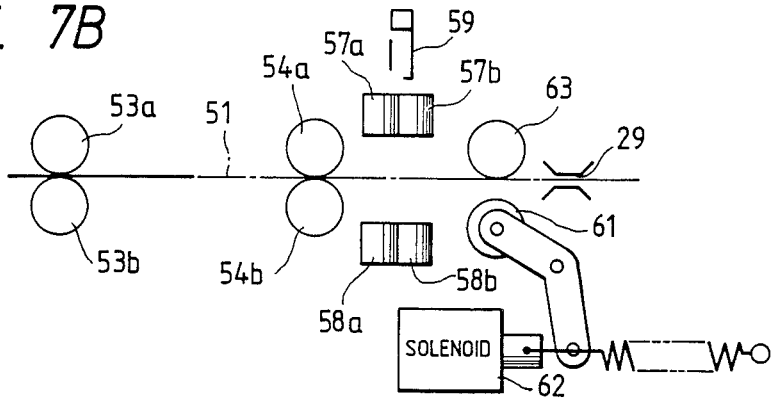
Figure 8A:
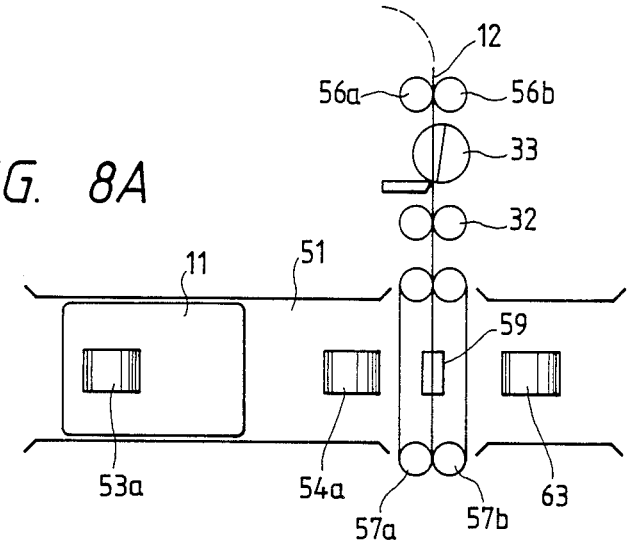
Figure 8B:
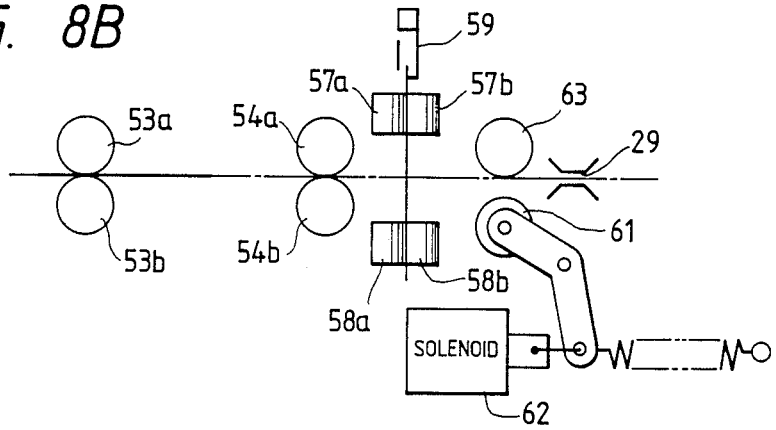

Next, the operation mechanism for ejecting the ticket 11 and the receipt 12 en bloc will be described. As shown in FIG. 6, the ticket 11 and the receipt 12 are transferred on transfer paths 51 and 52 of the ticket and receipt conveyors 25 and 34, respectively. The transfer paths 51 and 52 intersect each other so that the ticket and receipt surfaces also cross each other. As shown in FIGS. 7A and 7B, the transfer path 51 is defined by rollers **53*a*, 53*b* and 54*a*, 54*b* for feeding the ticket 11 while gripping it therebetween, and the fare-adjusted ticket 11 is fed in the direction indicated by the arrow 55. The receipt 12 is conveyed by rollers 56*a* and 56*b*, and as depicted in FIGS. 8A and 8B, it is drawn across the cutter 33 and the printer 32 and is then gripped between two parts of conveyor belts 57*a*, 57*b* and 58*a*, 58*b***.

Figure 9A:
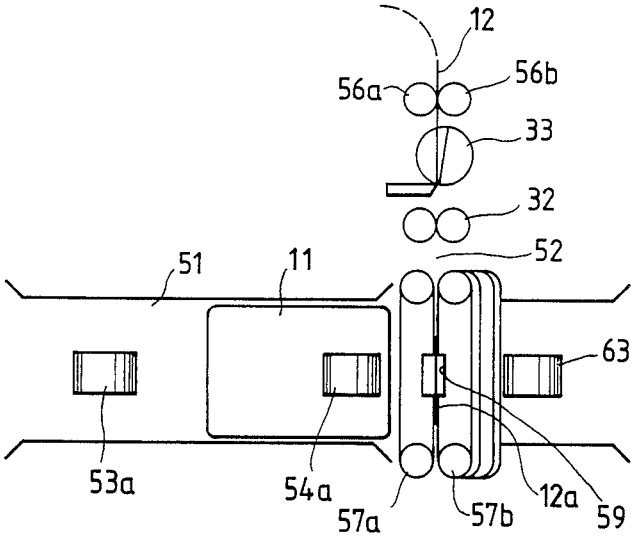
Figure 9B:
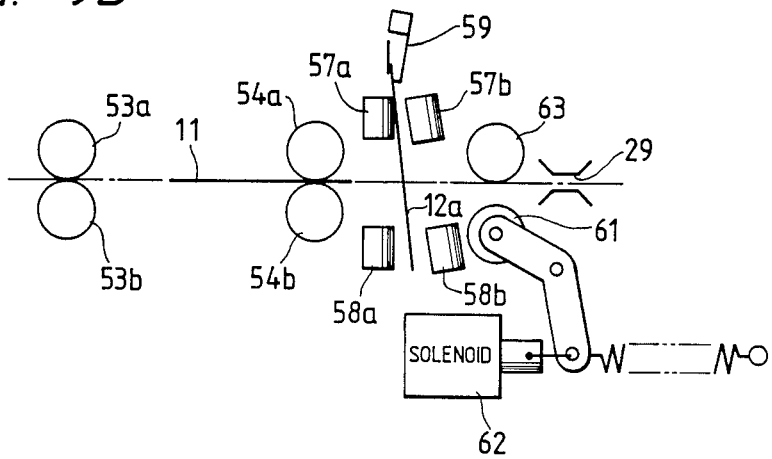
Figure 10A:
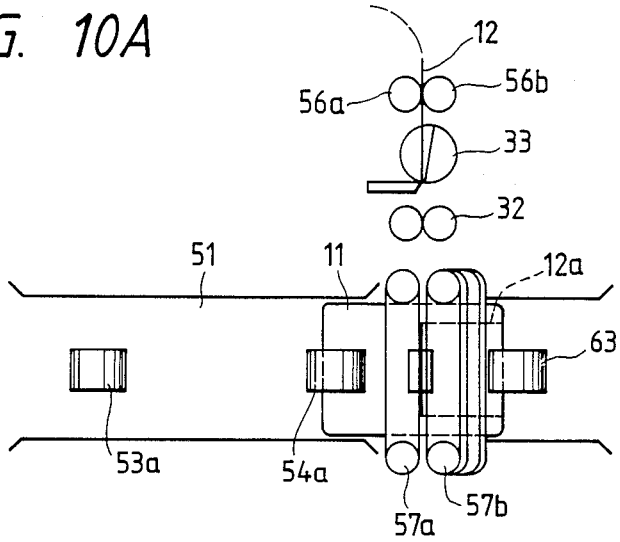
Figure 10B:
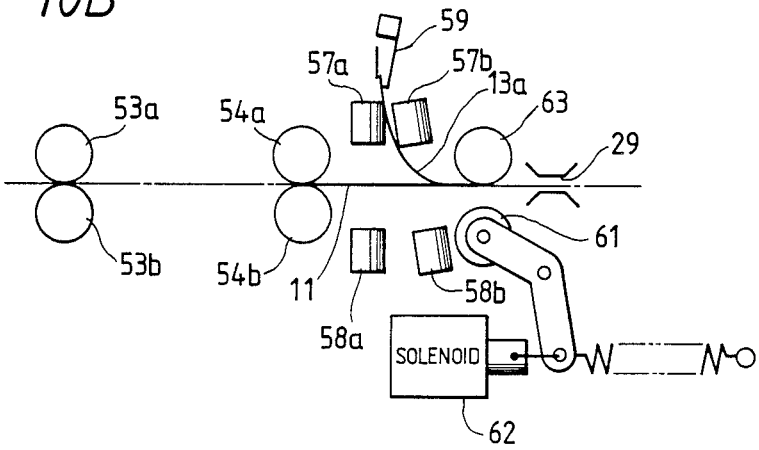
Figure 11A:
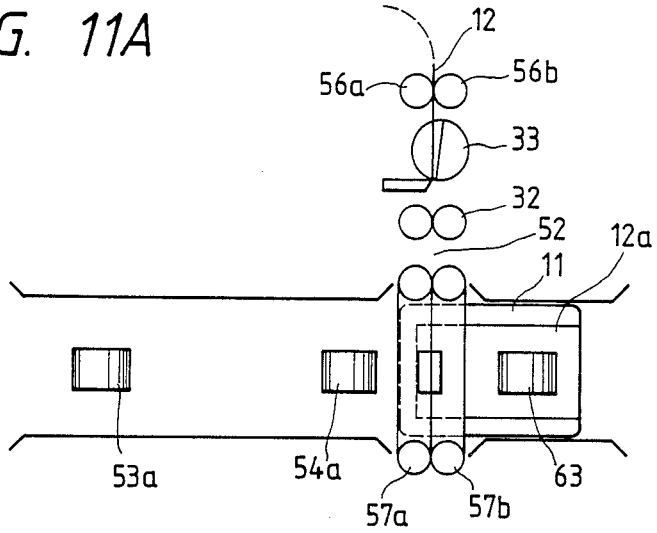
Figure 11B:
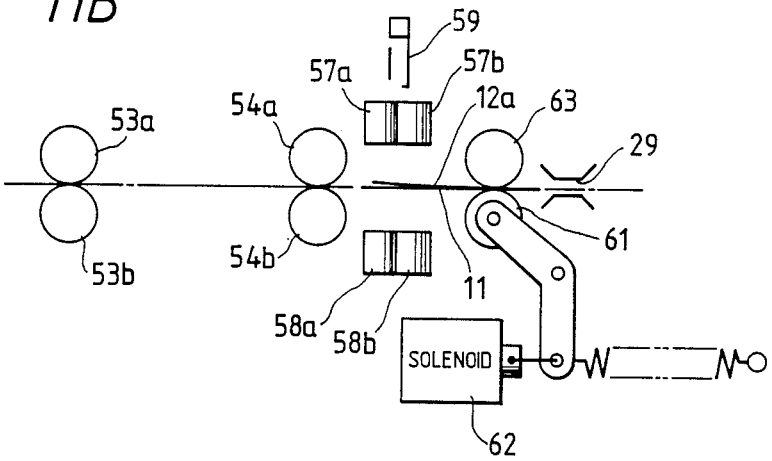

When the receipt **12*a* cut by the cutter 33 is brought to a predetermined position where the transfer paths 51 and 52 intersect each other, the receipt 12*a* is held at one side by a clamp mechanism 59 and, at substantially the same time, it is released from the conveyor belts 57*a*, 57*b* and 58*a*, 58*b*, as shown in FIGS. 9A and 9B. Thereafter the ticket 11 is transferred while pushing the receipt 12*a* as depicted in FIGS. 10A and 10B, and when the receipt 12*a* and the ticket 11 reach the position of a movable roller 61, a solenoid 62 is actuated to bring the roller 61 into rotary contact with a roller 63 so that the ticket 11 and the receipt 12*a* are gripped between and delivered to the outlet slot 29. In this way, the ticket 11 and the receipt 12** are discharged at the same time.

Figure 12:
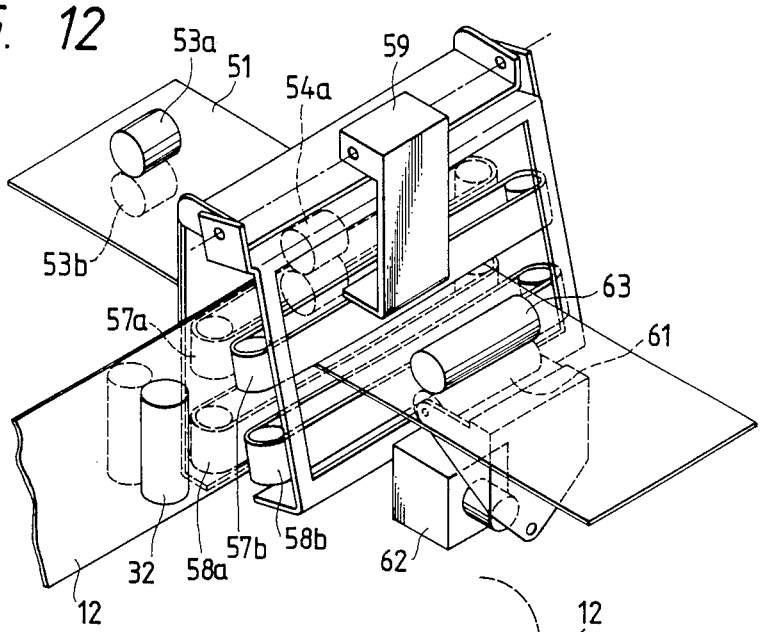
FIG. 12 is a perspective view showing the batch discharging mechanism depicted in FIGS. 7A to 11B.

The intersecting portion of the transfer paths 51 and 52 is shown, in perspective, in FIG. 12, in which the parts corresponding to those in FIGS. 7A and 7B are identified by the same reference numerals.

Figure 13A:
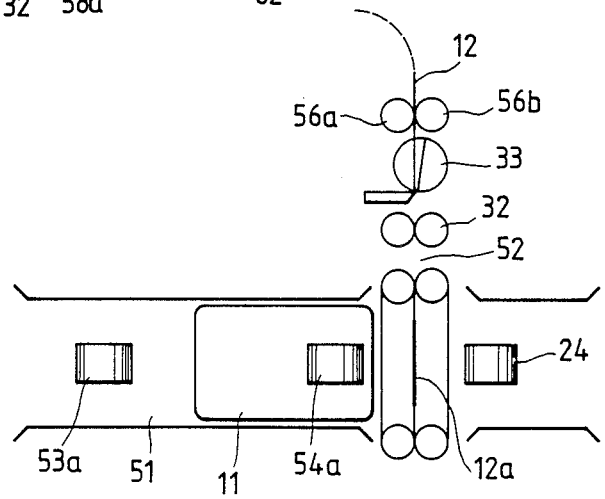
FIG. 13A through 15B schematically illustrate another example of the batch discharging mechanism, FIGS. 13A, 14A and 15A being its plan views and FIGS. 13B, 14B and 15B its front views.
Figure 13B:
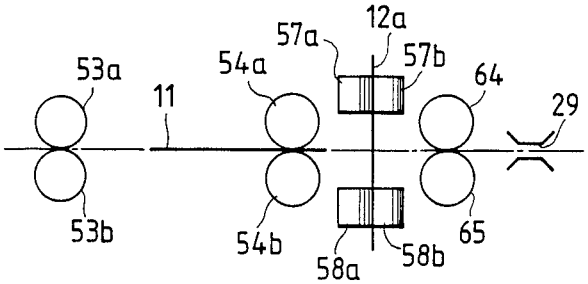

Next, a description will be given of another example of the mechanism for simultaneously ejecting the ticket 11 and the receipt 12. As depicted in FIGS. 13A and 13B, in which the parts corresponding to those in FIGS.

Figure 14A:
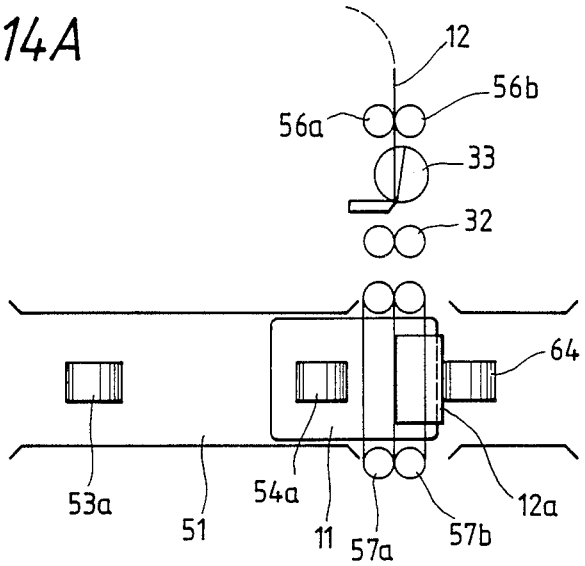
Figure 14B:
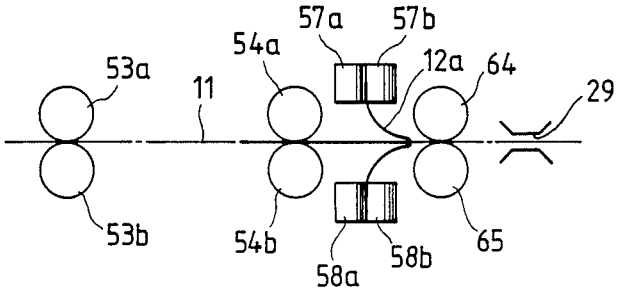
Figure 15A:
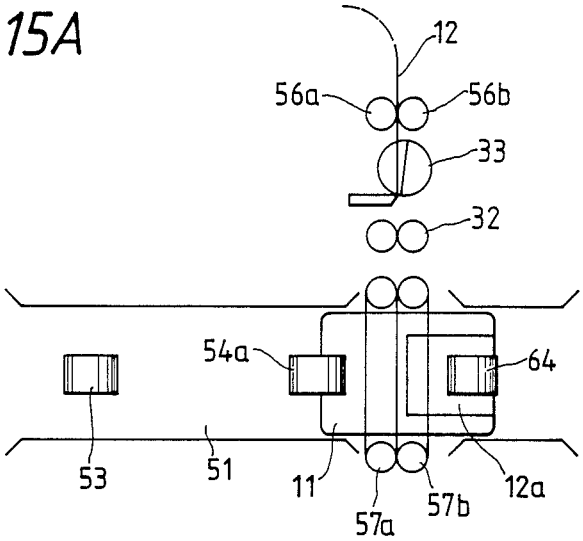
Figure 15B:
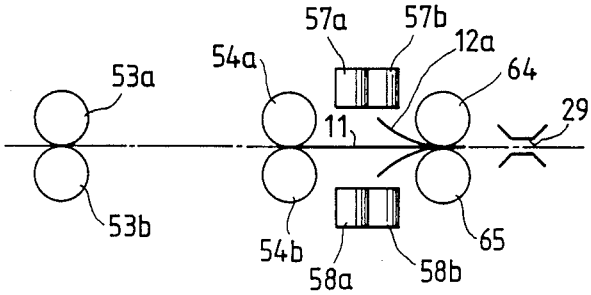

7A and 7B are identified by the same reference numerals, the transfer paths 51 and 52 are provided in the same manner as described above. When the ticket 11 is transferred on the path 51 and reaches a point just in front of the intersection, the receipt 12 is already held between the conveyor belts 57*a*, 57*b* and 58*a*, 58*b*. Feeding the ticket 11 into the intersection, the receipt 12*a* is pushed at its intermediate portion by the front marginal edge of the ticket 11 and folded into two, and consequently, the forward portion of the ticket 11 is wrapped thereinto as shown in FIGS. 14A and 14B. The receipt 12 and the ticket 11 partly wrapped therein are pressed into and between rollers 64 and 65, by which they are ejected to the outlet slot 29 at the same time, as shown in FIGS. 15A and 15B.

As described above, according to the present invention, the receipt is offered, from which the passenger can learn particulars about the fare adjustment. The receipt and the ticket are ejected from the same position, and hence they can be taken out at the same time. Only the receipt is offered to a passenger who pays the fare in cash, and since the receipt dispenser therefor is incorporated in the card processor, there is no need of providing the receipt dispenser separately of the card processor.

It will be apparent that many modifications and variations may be effected without departing from the scope of the novel concepts of the present invention.

What is claimed is:

1. A fare adjustment machine comprising:

a housing;

a card insertion slot formed through a wall of said housing for receiving a prepaid card type ticket having information recorded thereon;

card detecting means disposed inside said housing near said card insertion slot for detecting the insertion of said ticket into said card insertion slot;

read/write means disposed inside said housing for reading out and rewriting said information recorded on said ticket;

controller means for performing fare adjustment processing on the basis of both said read-out information and input fare information;

printing means disposed inside said housing for printing the contents of said fare adjustment processing and said input fare information on a receipt;

an outlet slot formed through a wall of said housing;

card conveying means within said housing responsive to the detection of said ticket by said card detecting means for conveying said ticket from said card insertion slot past said read/write means toward said outlet slot;

receipt conveying means within said housing for conveying said receipt, said card conveying means and said receipt conveying means respectively defining first and second transfer paths that intersect one another;

a clamp mechanism disposed at the intersection between said first and second transfer paths for so holding said receipt that, when said prepaid card type ticket enters said intersection, an edge of said ticket pushes against a surface of said receipt;

means for releasing said receipt from said receipt conveying means to permit said ticket and said receipt to overlie each other as said ticket is conveyed toward said outlet slot by said card conveying means; and discharge means positioned between said intersection and said outlet slot for gripping said overlying ticket and receipt and delivering them through said outlet slot.

2. The fare adjustment machine of claim 1 wherein a further outlet slot is formed through said housing wall, said machine including receipt eject means disposed between said intersection and said further outlet slot for receiving a receipt that is conveyed by said receipt conveying means across said intersection without being engaged by a ticket and for ejecting said receipt through said further outlet slot.

3. The fare adjustment machine of claim 1 or 2 wherein said housing includes a roll of paper whose leading end is fed to said printing means, and cutting means for severing a predetermined length of imprinted paper from said roll to form said receipt.

4. The fare adjustment machine of claim 1 or 2 wherein said housing includes a supply of blank receipts which are fed individually to said printing means to form imprinted receipts.

* * * * *